US006116352A

United States Patent [19]

Frauhammer et al.

[11] Patent Number: 6,116,352

[45] Date of Patent: Sep. 12, 2000

[54] DRILLING AND/OR PERCUSSION POWER TOOL

[75] Inventors: Karl Frauhammer, Leinfelden-Echterdingen; Frank Mueller, Deckenpfronn; Andreas Strasser, Rudersberg, all of Germany

[73] Assignee: Robert Bosch GmbH, Stuttgart, Germany

[21] Appl. No.: 09/262,687

[22] Filed: Mar. 4, 1999

[30] Foreign Application Priority Data

Mar. 10, 1998 [DE] Germany ..... 198 10 088

[51] Int. Cl.[7] ..... B25D 11/04

[52] U.S. Cl. ..... 173/212; 173/48; 173/109; 173/201

[58] Field of Search ..... 173/201, 109, 173/48, 104, 200, 210, 212

[56] References Cited

U.S. PATENT DOCUMENTS

| | | | |
|---|---|---|---|
| 3,866,692 | 2/1975 | Stelljes | 173/48 |
| 3,926,266 | 12/1975 | Dorgnon | 173/48 |
| 4,349,074 | 9/1982 | Ince . | |
| 5,111,890 | 5/1992 | Ranger et al. | 173/201 |
| 5,379,848 | 1/1995 | Rauser | 173/48 |
| 5,435,397 | 7/1995 | Demuth | 173/48 |
| 5,456,324 | 10/1995 | Takagi et al. | 173/48 |
| 5,775,440 | 7/1998 | Shinma | 173/201 |
| 5,873,418 | 2/1999 | Arakawa et al. | 173/201 |

FOREIGN PATENT DOCUMENTS

WO 90/01400 2/1990 WIPO .

*Primary Examiner*—Scott A. Smith
*Attorney, Agent, or Firm*—Michael J. Striker

[57] ABSTRACT

A drilling and a percussion power tool and the tool holder, a housing, an air cushion percussion mechanism arranged in the housing and including a guiding tube, a piston reciprocating in the guiding tool, a striker reciprocating in the guiding tube, an air cushion chamber formed on the guiding tube between the striker and the piston, at least one control opening ventilating the air cushion chamber in an idling position of the percussion mechanism, a control part which in a percussion operation closes the at least one control opening for forming an air cushion in the air cushion chamber, and at least one additional opening formed in the guiding tube for ventilating of the air cushion chamber and arranged forwardly of the at least one control opening at a side of a tool so that in the percussion operation the at least one additional opening is covered by the striker.

3 Claims, 1 Drawing Sheet

DRILLING AND/OR PERCUSSION POWER TOOL

BACKGROUND OF THE INVENTION

The present invention relates to a drilling and/or a percussion power tool.

A drilling and/or a percussion power tool is disclosed for example in the European patent document EP 0 429 475 A1. This power tool has a tool holder and an air cushion percussion mechanism arranged in a housing. The air cushion percussion mechanism has a guiding tube, in which a piston and a striker perform a reciprocating movement. An air cushion chamber is formed between the piston and the striker and then it is ventilated through at least one control opening in an outlet position of the percussion mechanism. The formation of an air cushion with the ventilated air cushion chamber is not possible, so that the percussion mechanism is turned off.

For releasing the percussion operation, the control opening is closeable by a control part arranged outside of the guiding tube. During pressing of a tool inserted in the tool holder against a treatment point, a displacement of the guiding tube is performed against a return force, until the control opening is closed by the control part. With the closed control opening, a pressure or suction, or so-called air cushion, can be formed in the air cushion chamber. The piston and the striker are axially reciprocatingly coupled through the air cushion.

SUMMARY OF THE INVENTION

Accordingly, it is an object of the present invention to provide a drilling and/or a percussion power tool which, in addition to the pressure-dependent sealing of at least one control opening by a control part, as a further criterion for the releasing of the percussion operation is provided with a tool dependent sealing of the air cushion chamber.

These objectives are achieved in that in the guiding tube additionally at least one additional opening is provided for ventilation of the air cushion chamber, which is arranged at the side of the tool before the at least one control opening and is covered during the percussion operation by the striker.

When the power tool is designed in accordance with the present invention, then a percussion operation is possible only with a predetermined tool, and only when the corresponding tool which satisfies the requirements is inserted in the receptacle.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
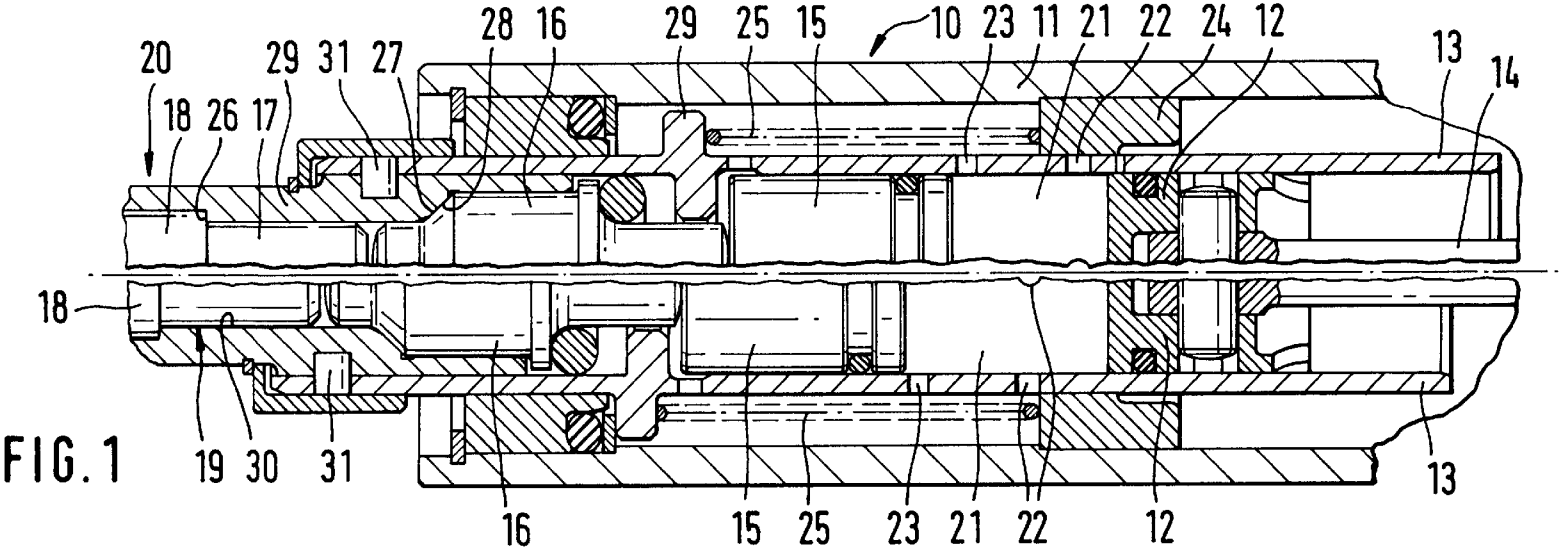
FIG. 1 is a view showing a longitudinal section of a drilling power tool (power drill) with an inserted tool in two different axial positions of the guiding tube.
Figure 2:
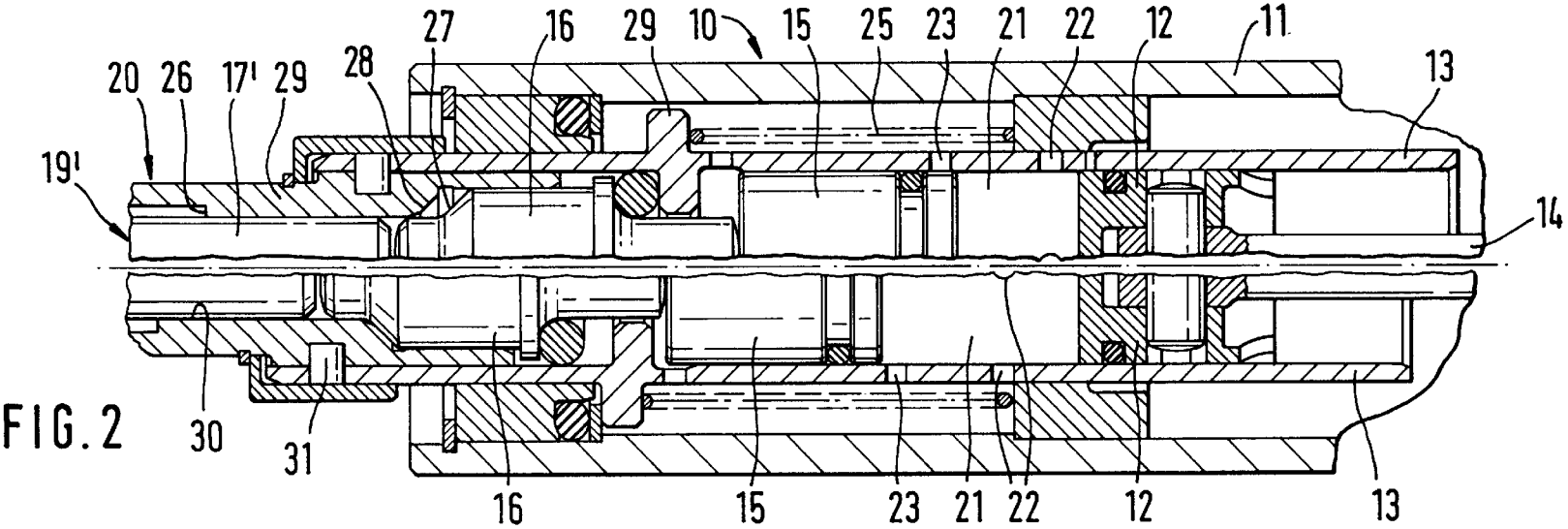
FIG. 2 is a view showing a longitudinal section through the drilling power tool of FIG. 1, with an inserted percussion tool, also in two different axial positions of the guiding tube.

FIGS. 1 and 2 show a hammer drill in which a percussion mechanism is identified with reference numeral 10. It is arranged in a housing 11 of the hammer drill. The percussion mechanism 10 is formed as an air cushion percussion mechanism and has a guiding tube 13. The guiding tube is supported in a housing 11 axially displaceably with a predetermined limit and is rotatably driveable by a not shown drive device.

A piston 12 is axially displaceably received in the guiding tube 13. The piston 12 is driven through a piston rod 14 from a not shown eccentric in a reciprocating manner. A striker 15 is located in the guiding tube 13 at a distance from the piston 12 and forwardly is supported on an anvil 16. The anvil 16 is provided with a supporting surface 27 having an outer conical shape, through which it is supported forwardly on a ring collar 28 of a base body 29. The base body 29 is tubular, similarly to the guiding tube 13, and engages it at an end side. Two pins 30 connect the base body 29 with the guiding tube 13 in a form-locking manner both in the axial direction and the peripheral direction. The base body 29 is a part of a tool holder 20 of the hammer drill, which forms a receiving opening 30 for insertion of a tool 19, 19'.

An air cushion chamber 21 is formed in the guiding tube 13 between the piston 12 and the striker 13. The guiding tube 13 has several radially extending control openings 22 for ventilation of the air cushion chamber 21. A ring-shaped circular housing-fixed control part 24 surrounds the guiding tube 13 and receives it in an axially displaceable manner. The control part 24 is located in the region of the control openings 22. The guiding tube 13 is axially subjected to the action of a force of a return spring 25. The return spring abuts on the one hand against the control part 24 and on the other end on a circumferential collar 29 which extends outwardly from the outer surface of the guiding tube 13. The return spring 25 holds the guiding tube 13 always in a front initial position. Depending on the axial position of the guiding tube 13, the control part 24 overlaps the control opening 22 (percussion position), or releases these openings for ventilation (idling position).

Several additional openings 23 are located forwardly of the control openings 22 at the side of the tool in the guiding tube 13. They are also provided for ventilation of the air cushion chamber 21. Depending on the axial position of the striker 12, the additional openings 23 are covered by it (percussion position) or opened (idling position).

The operation of the hammer drill corresponds to the operation of the hammer drill disclosed in the above mentioned European patent document EP 429 475 A1, so that it is not described in detail, and the reference is incorporated here by means of a reference. For activation of the percussion mechanism 10 it is required that the air cushion chamber 21 is sealed, so that an air cushion 21 is provided between the piston 12 and the striker 15. When an air cushion is available, the piston 12 and the striker 15 are coupled in the sense of a reciprocating axial movement. Conditions for producing the air cushion is that both the control openings 22 and the additional openings 23 are closed. Only then the air cushion chamber 21 is sufficiently sealed from the atmosphere.

FIGS. 1 and 2 differ from one another basically by the type of the tools 19 and 19' insertable in the tool holder 20. The tool 19 shown in FIG. 1 is formed as a drilling tool which is not provided for a percussion operation. The tool 19 is provided with a collar 18 which limits a penetration depth of the shaft end 17 into the tool holder 20. In the upper half of the hammer drill shown in FIG. 1 a pressing position against a not shown work piece is illustrated. The tool 19 is inserted in the tool receptacle 20 and abuts with the collar 18 axially against a radial abutment surface 26 in the receiving opening 30. The pressing force of the operator is transmitted to the tool 19 through the abutment surface 26. The guiding tool 19 is displaced opposite to the force of the return spring 25 rearwardly in the housing 11. In this position the control openings 22 are covered by the control part and thereby closed. The collar 18 prevents a further penetration of the tool 19 into the tool holder 20 so that the anvil 16 and the striker 15 can not be displaced from the shaft end 17 in direction to the additional opening 23. Therefore, despite the pressed hammer drill, the percussion mechanism 10 with the tool 19 shown in FIG. 1 can not be activated because of the always opened additional openings 23.

The lower half of FIG. 1 shows the hammer drill in its initial position without a tool pressure. In this position the hammer drill is removed from the treatment point, so that the guiding tube 13 is displaced by the force of the return spring 25 to its front initial position. In this position the control openings 22 are released.

FIG. 2 shows a tool 19' which is inserted in the tool holder 20 and has a longer shaft end 17'. With this tool 19', the tool holder 20 during pressing of the hammer drill against the treatment point, is displaced inwardly through a not shown locking block for the tool locking of the tool 19'. The control openings 22 are closed by the control parts 24. Simultaneously, the anvil 16 and the striker 15 are pressed axially rearwardly through the relatively long shaft end 17', until the striker 15 overlaps the additional openings 23. In this position the air cushion chamber 21 is completely closed, so that an air cushion can be formed between the piston 12 and the striker 15. Then, in the known manner the air cushion acts for transmission of the drive energy from the piston 12 to the striker 15. The activation of the percussion mechanism is thereby dependent on the penetration depth of a tool 19 or 19'. Only when the tool 19' penetrates sufficiently deep, the striker 15 through the anvil 16 can displace axially to the additional openings 23, so that the percussion mechanism 10 can be set in operation. During the percussion operation the striker 15 is then held by the shaft end 17' in its position in which it covers the additional openings. The anvil 16 applies its axial impact directly against the shaft end 17'.

In the lower half of FIG. 2, the hammer drill 10 is again withdrawn from the treatment point. The guiding tube 13 is displaced by the return spring 25 to its front initial position, in which the control openings 22 and the additional openings 23 are released.

It will be understood that each of the elements described above, or two or more together, may also find a useful application in other types of constructions differing from the types described above.

While the invention has been illustrated and described as embodied in a drilling and/or percussion power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drilling and a percussion power tool, comprising a tool holder; a housing; an air cushion percussion mechanism arranged in said housing and including a guiding tube, a piston reciprocating in said guiding tube, a striker reciprocating in said guiding tube, an air cushion chamber formed in said guiding tube between said striker and said piston; at least one control opening ventilating said air cushion chamber in an idling position of said percussion mechanism; a control part which in a percussion operation closes said at least one control opening for forming an air cushion in said air cushion chamber depending on a pressure on a treatment point; and at least one additional opening formed in said guiding tube for ventilation of said air cushion chamber and arranged forwardly of said at least one control opening at a side of a tool so that in a percussion operation said at least one additional opening is covered by said striker, depending on the tool inserted in said tool holder.

2. A drilling and percussion power tool as defined in claim 1; and further comprising a tool insertable in said tool holder said at least one additional opening being closed in dependence on a penetration depth of said tool inserted in said tool holder.

3. A drilling and percussion power tool as defined in claim 1, wherein said tool holder has at least one receiving opening with a radial abutment surface for a tool, said receiving opening being provided with a collar in a region of a shaft end of said tool for limiting a penetration depth of said tool.

* * * * *